US007712935B2

(12) United States Patent
Tsukamoto et al.

(10) Patent No.: US 7,712,935 B2
(45) Date of Patent: May 11, 2010

(54) LAMP UNIT

(75) Inventors: Michio Tsukamoto, Shizuoka (JP); Kazuhisa Mochizuki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 12/041,929

(22) Filed: Mar. 4, 2008

(65) Prior Publication Data

US 2008/0225540 A1 Sep. 18, 2008

(30) Foreign Application Priority Data

Mar. 15, 2007 (JP) ..... 2007-067523

(51) Int. Cl.
*F21V 5/00* (2006.01)

(52) U.S. Cl. ..... 362/522; 362/545; 362/299; 362/300; 362/311.06

(58) Field of Classification Search ..... 362/545, 362/520, 522, 307, 311.01, 311.02, 311.06, 362/517–518, 297, 299, 300
See application file for complete search history.

(56) References Cited

U.S. PATENT DOCUMENTS

| | | | | |
|---|---|---|---|---|
| 1,888,995 | A | 11/1932 | Matter | |
| 4,050,775 | A | 9/1977 | Scholten | |
| 4,583,153 | A * | 4/1986 | Tsuyama | 362/517 |
| 5,050,051 | A * | 9/1991 | Machida et al. | 362/503 |
| 5,103,381 | A | 4/1992 | Uke | |
| 5,287,101 | A * | 2/1994 | Serizawa | 340/815.76 |
| 6,705,736 | B1 | 3/2004 | Pressler | |
| 6,960,006 | B2 * | 11/2005 | Abe | 362/538 |
| 7,478,932 | B2 * | 1/2009 | Chinniah et al. | 362/507 |
| 2004/0184280 | A1 * | 9/2004 | Ishida et al. | 362/507 |
| 2004/0202007 | A1 * | 10/2004 | Yagi et al. | 362/545 |
| 2005/0122736 | A1 | 6/2005 | Watanabe et al. | |
| 2005/0225995 | A1 | 10/2005 | Komatsu et al. | |
| 2006/0083000 | A1 * | 4/2006 | Yoon et al. | 362/311 |
| 2007/0127257 | A1 * | 6/2007 | Erion et al. | 362/547 |
| 2007/0183168 | A1 * | 8/2007 | Naganawa et al. | 362/545 |

FOREIGN PATENT DOCUMENTS

| | | |
|---|---|---|
| JP | 2001-249405 A | 9/2001 |
| JP | 2004-95480 A | 3/2004 |
| JP | 2005-56704 A | 3/2005 |

OTHER PUBLICATIONS

Extended European Search Report dated Jun. 13, 2008.
Chinese Office Action dated Mar. 27, 2009.

* cited by examiner

*Primary Examiner*—Jong-Suk (James) Lee
*Assistant Examiner*—Julie A Shallenberger
(74) *Attorney, Agent, or Firm*—Sughrue Mion, PLLC

(57) ABSTRACT

A lamp unit is provided. The lamp unit includes a light emitting element disposed on an optical axis so as to face in a direction substantially orthogonal to the optical axis, a first reflector facing the light emitting element to forwardly reflect light from the light emitting element, and a direct light control member disposed in front of the light emitting element for controlling direct light directed toward a region in front of the first reflector from the light emitting element without being incident on the first reflector. The direct light control member includes a first lens portion which deflects a first portion of the direct light in a direction approaching the optical axis, and an extended portion extending from the first lens portion. The extended portion controls a second portion of the direct light differently from the first lens portion.

12 Claims, 6 Drawing Sheets

LAMP UNIT

FIELD OF THE PRESENT INVENTION

Apparatuses consistent with the present invention relate to a lamp unit adapted to be incorporated into a lamp, and more particularly, to a lamp unit for use in a vehicle and having a light emitting element as a light source.

DESCRIPTION OF THE RELATED ART

In recent years, related art lamp units having a light emitting element as a light source, e.g., a light emitting diode, are increasingly being used in lamps such as vehicle headlamps.

For example, there has been proposed a reflector-type lamp unit having a light emitting element disposed on an optical axis extending in a front-and-rear direction of the lamp unit, and a reflector disposed above the light emitting element. The light emitting element is oriented orthogonally upward with respect to the optical axis, and light from the light emitting element is reflected in a forward direction by the reflector (see, e.g., JP 2004-095480 A).

However, in such a related art reflector-type lamp unit having a light emitting element that is oriented in a direction orthogonal to the optical axis, some light from the light emitting element is directed toward a region in front of the reflector without being incident on the reflector. This direct light from the light emitting element is irradiated in the forward direction as diffusion light, and does not contribute much to forming a light distribution pattern.

In order to address the above disadvantages, there has been proposed a related art reflector-type lamp unit having a light emitting element that is oriented upward but is inclined rearward with respect to a direction orthogonal to an optical axis (see, e.g., JP 2005-056704 A). According to this configuration, an amount of light incident on the reflector from the light emitting element increases, whereby a luminous flux of the light emitting element can be effectively utilized. Thus, it is possible to improve lamp efficiency.

However, there still remain some disadvantages. For example, in such a related art reflector-type lamp unit, light reflected by a portion of a reflecting surface near a front edge of the reflector generally forms a small and bright image of a light source, and therefore, is suitable for forming a hot zone (i.e., a high luminous intensity region) of a light distribution pattern. However, the light emitting from the light emitting element has a strong directivity, and the light emitting element has a luminous intensity distribution such that the luminous intensity is high in a direction orthogonal to a light emitting surface of the light emitting element. Thus, in a case where the light emitting element is inclined rearward, the direction orthogonal to the light emitting surface of the light emitting element is largely deviated to a rear side of the portion of the reflecting surface near the front edge of the reflector. Therefore, it becomes difficult to form a sufficiently bright hot zone in the light distribution pattern by the light reflected from the portion of the reflecting surface near the front edge of the reflector.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any of the problems described above.

One or more exemplary embodiments of the present invention provide a reflector-type lamp unit having a light emitting element as a light source. Lamp efficiency of the lamp unit is improved while ensuring a sufficient brightness of a hot zone in a light distribution pattern.

According one or more exemplary embodiments of the present invention, a lamp unit includes a light emitting element disposed on an optical axis extending in a front-and-rear direction of the lamp unit, the light emitting element being oriented to face in a direction substantially orthogonal to the optical axis, a first reflector facing the light emitting element to forwardly reflect light from the light emitting element, and a direct light control member disposed in front of the light emitting element for controlling direct light from the light emitting element, the direct light being directed toward a region in front of the first reflector without being incident on the first reflector. The direct light control member includes a first lens portion which deflects a first portion of the direct light in a direction approaching the optical axis, and an extended portion extending from the first lens portion toward a rear side of the first lens portion. The extended portion controls a second portion of the direct light differently from the first lens portion.

DETAILED DESCRIPTION OF EXEMPLARY EMBODIMENTS OF THE PRESENT INVENTION

Hereinafter, exemplary embodiments of the present invention will be described with reference to the drawings. The following exemplary embodiments do not limit the scope of the invention.

First Exemplary Embodiment

Figure 1:
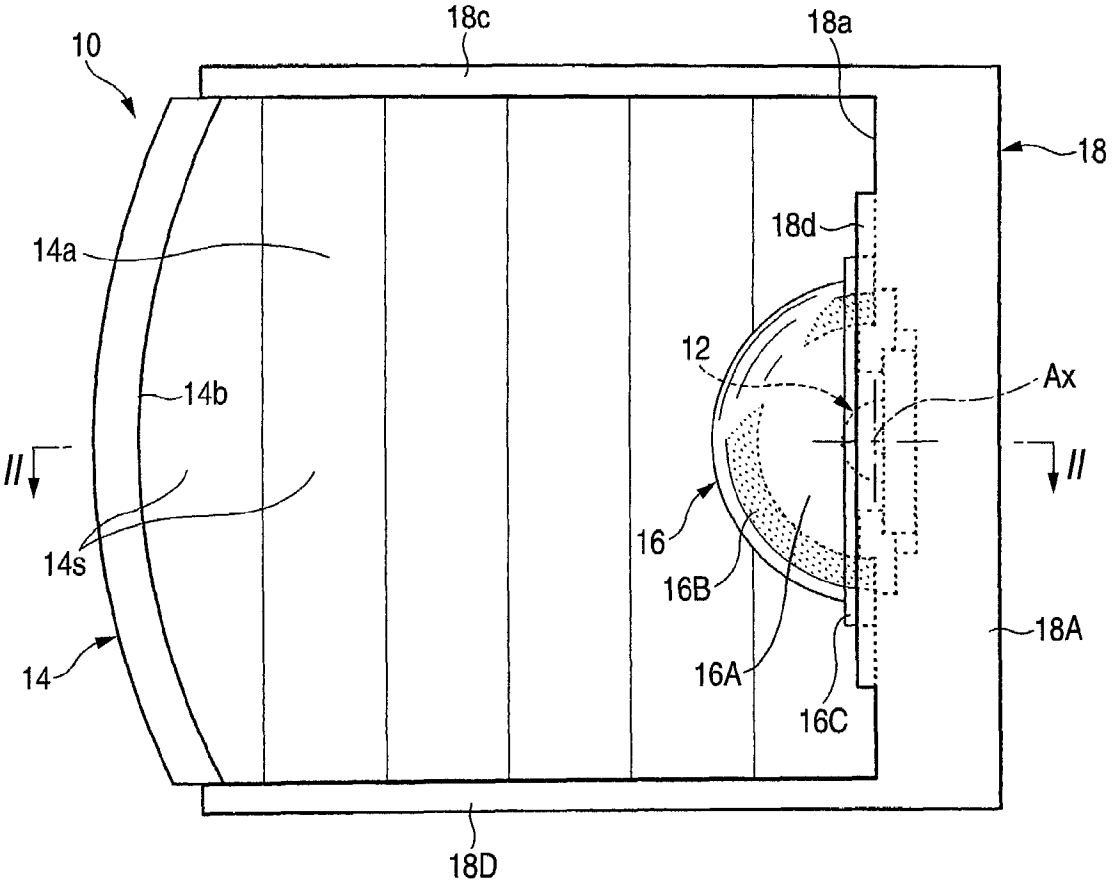
FIG. 1 is a front view of a lamp unit according to a first exemplary embodiment of the present invention.
Figure 2:
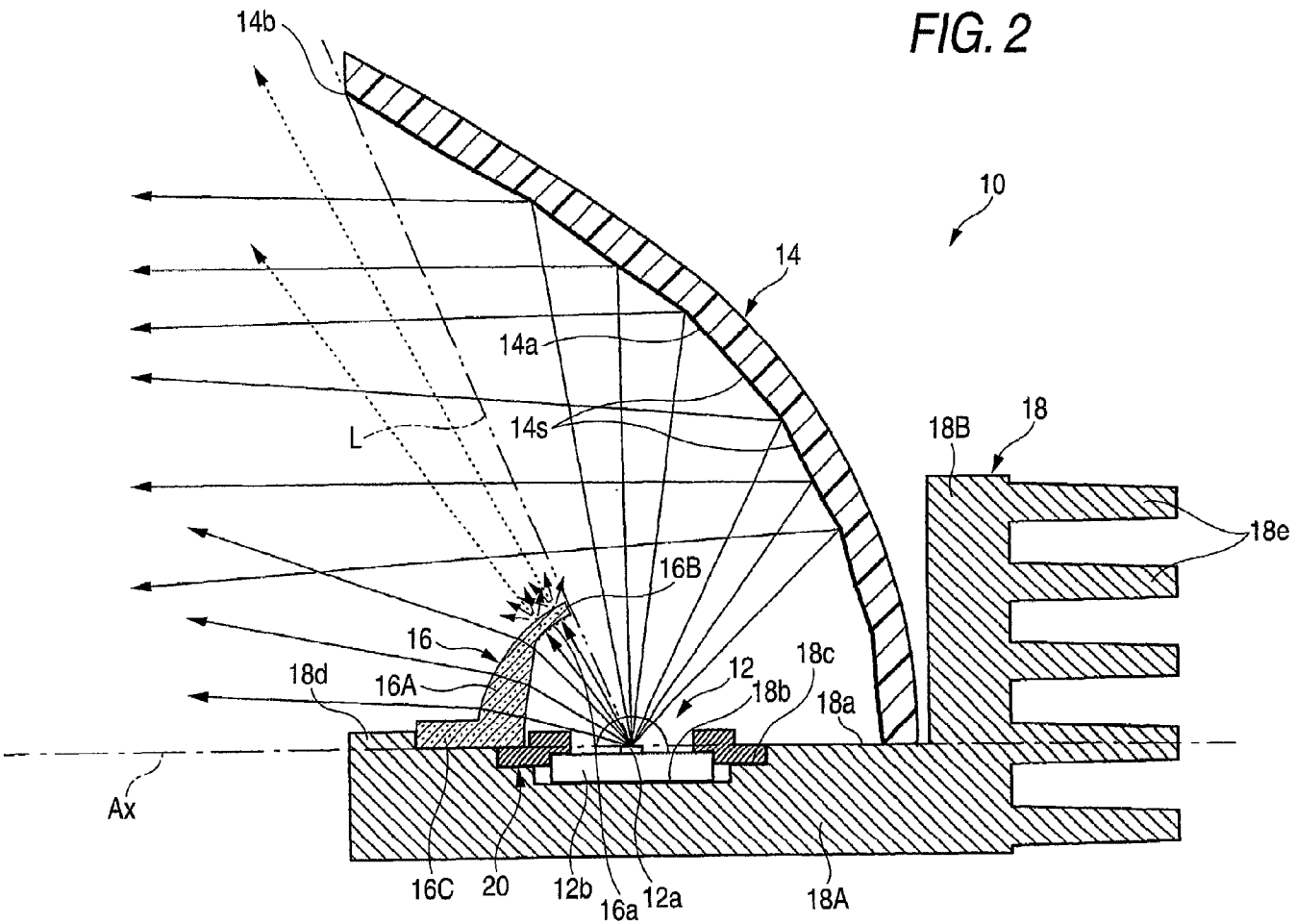
FIG. 2 is a sectional view taken along the line II-II in FIG. 1.

FIG. 1 is a front view of a lamp unit 10 according to a first exemplary embodiment of the present invention, and FIG. 2 is a sectional view taken along the line II-II in FIG. 1.

As shown in FIGS. 1 and 2, the lamp unit 10 is a reflector-type lamp unit including a light emitting element 12 as a light source. The lamp unit 10 may be adapted to be incorporated in a vehicle headlamp (not shown), for example, on a left side of a front end portion of a vehicle. The lamp unit 10 is arranged such that an optical axis Ax thereof extends in a front-and-rear direction of the lamp unit 10 so as to irradiate light to form a portion of a low-beam light distribution pattern. The front-and-rear direction of the lamp unit 10 may be or may not coincide with a front-and-rear direction of a vehicle.

The light emitting element 12 is disposed on the optical axis Ax, and is oriented inward in a width direction. The lamp unit 10 further includes a first reflector 14 disposed on an inner side of the light emitting element 12 in the width direction, a direct light control member 16 disposed just in front of the light emitting element 12, a metallic bracket 18 supporting the light emitting element 12, the first reflector 14 and the direct light control member 16, and a frame-like fixing member 20 fixing and positioning the light emitting element 12 to the metallic bracket 18. The first reflector 14 reflects light from the light emitting element 12 in a forward direction, while the direct light control member 16 controls light that is directed toward a region in front of the first reflector 12 from the light emitting element 12 without being incident on the first reflector 14.

The metallic bracket 18 has an L-shape when viewed in a plan view. The metallic bracket 18 includes a vertical wall 18A extending in the forward direction, another vertical wall 18B extending toward the inner side in the width direction of the vehicle, an upper wall 18C formed on upper edges of the vertical walls 18A, 18B, and a lower wall 18D formed on lower edges the vertical walls 18A, 18B. A wall surface 18*a* of the vertical wall 18A on the inner side of the width direction extends along a vertical plane including the optical axis Ax.

The light emitting element 12 is a white light emitting diode, and includes a light emitting chip 12*a* having a square light emitting surface, a substrate 12*b* supporting the light emitting chip 12*a*, and a sealing resin hemispherically covering the light emitting chip 12*a*. Dimensions of the light emitting surface is, for example, about 1 mm by about 1 mm.

A recessed portion 18*b* is formed on the wall surface 18*a* of the vertical wall 18A. The light emitting element 12 is disposed inside the recessed portion 18*b*, and is fixedly supported on the metallic bracket 18. The fixing member 20 engages with a circumferential edge portion of the substrate 12*b*, and presses the substrate 12*b* from the inner side in the width direction, thereby positioning the light emitting element 12 with respect to the metallic bracket 18. An annular stepped portion 18*c* is formed around the recessed portion 18*b* of the vertical wall 18A for positioning the fixing member 20 therein.

The first reflector 14 has a reflecting surface 14*a*. The reflecting surface 14*a* includes a plurality of reflecting elements 14*s* that are arranged to form a vertical stripe pattern along a reference surface. The reference surface is a paraboloid of revolution having the optical axis Ax as a center axis, and a light emitting center of the light emitting element 12 as a focal point. Each of the reflecting elements 14*s* diffusely reflects the light from the light emitting element 12 such that the light is diffused in the width direction and is directed slightly downward. A diffusing angle of each of the reflecting elements 14*s* is set to become smaller toward the inner side of the width direction. In other words, the reflecting element 14*s* disposed closer to the optical axis Ax has a larger diffusing angle than the reflecting element 14*s* disposed farther from the optical axis Ax.

The first reflector 14 has such an external shape that upper and lower potions thereof are cut in parallel to have an upper end surface and a lower end surface having an equal distance from the optical axis Ax. The first reflector is supported on the metallic bracket 18 at the upper and lower end surfaces and an end surface facing outward in the width direction.

The direct light control member 16 is a resin molded member, and is transparent and colorless. The direct light control member 16 is configured to control the light that is directed toward the region in front of the first reflector 14 without being incident on the first reflector 14.

More specifically, the direct light control member 16 includes a first lens portion 16A operable to deflect the light in a direction approaching the optical axis Ax, an extended portion 16B extending toward the inner side of the width direction from the first lens portion 16A, and a base portion 16C for positioning and fixing the direct light control member 16 to the metallic base 18. The extended portion 16B is operable to control the light in a different manner from the first lens portion 16A. When seen in a front view, the direct light control member 16 has a hemispherical shape disposed on the inner side of the vertical plane including the optical axis Ax with respect to the width direction.

When seen in a plan view, the first lens portion 16A and the extended portion 16B extend substantially in an arc shape so as to surround the light emitting center of the light emitting element 12. An angle formed by the optical axis Ax and a straight line connecting the light emitting center of the light emitting element 12 and a boundary point between the first lens portion 16A and the extended portion 16B is about 40° to about 50°. A rear edge of the extended portion 16B is positioned on or near a straight line L connecting the light emitting center of the light emitting element 12 and a front edge 14*b* of the reflecting surface 14*a* of the first reflector 14.

The first lens portion 16A includes a front surface having a spherical shape, and a rear surface having a freely curved shape whose curvature is smaller than that of the front surface. The first lens portion 16A downwardly deflects the light from the light emitting element 12 in the direction approaching the optical axis Ax.

A thickness of the extended portion 16B is substantially constant. The extended portion 16B is formed so as to circumferentially surround the first lens portion 16A with respect to the optical axis Ax. A rear surface 16*a* of the extended portion 16B is subjected to an engraving treatment. According to this configuration, the light incident on the rear surface 16*a* of the extended portion 16B from the light emitting element 12 is randomly diffused in the forward direction.

The base portion 16C extends in the forward direction in a shape of a flat plate from an end portion of the first lens portion 16A on the outer side in the width direction. The base portion 16C is fixedly supported on the metallic bracket 18 such that a flat surface of the base portion 16C on the outer side in the width direction is in contact with the wall surface 18*a* of the vertical wall 18A.

A protruded portion 18*d* is provided at a front end portion of the wall surface 18*a* of the vertical wall 18A for positioning the direct light control member 16.

A plurality of radiator fins 18*e*, each extending in a vertical direction, are formed on a rear surface of the vertical wall 18B of the metallic bracket 18.

Figure 3:
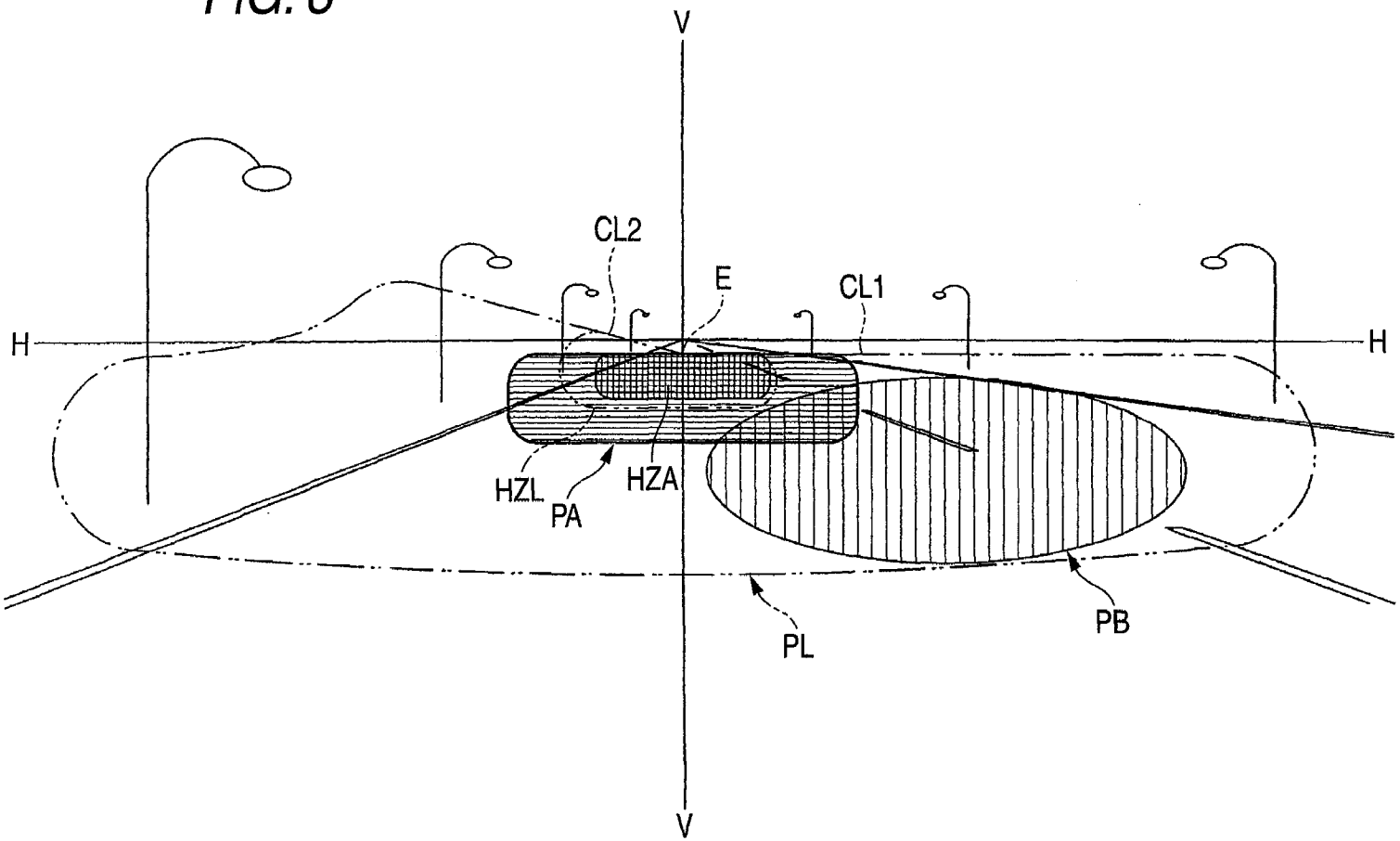
FIG. 3 is a perspective view showing two light distribution patterns projected, from the lamp unit of FIG. 1, on an imaginary vertical screen disposed at a position 25 m in front of the lamp unit.

FIG. 3 a perspective view showing two light distribution patterns PA, PB projected, from the lamp unit 10 according to the first exemplary embodiment, on an imaginary vertical screen disposed at a position 25 m in front of the lamp unit 10.

As shown FIG. 3, the light distribution patterns PA, PB form a part of a low-beam light distribution pattern PL indicated by a chain double-dashed line. The low-beam light distribution pattern PL is formed by combining the light distribution patterns PA, PB and other light distribution pattern(s) formed by light irradiated from other lamp unit(s) (not shown).

The low-beam light distribution pattern PL is for a left-hand traffic, and has a horizontal cut-off line CL1 and an oblique cut-off line CL2 along an upper edge thereof An elbow point E, at which the two cut-off lines CL1, CL2 intersect, is disposed about 0.5° to about 0.6° below a vanishing point H-V in the forward direction of the lamp. The low-beam light distribution pattern PL includes a hot zone HZL, which is a high luminous intensity region, surrounding the elbow point E. A section of the hot zone HZL on a left side of the elbow point E is larger that a section of the hot zone HZL on a right side of the elbow point E.

The light distribution pattern PA is formed by the light that is reflected by the first reflector 14, and an upper edge thereof is substantially coincident with the horizontal cut-off line CL1.

The light distribution pattern PA is formed so as to straddle the line V-V, and is a bright light distribution pattern having a narrow vertical width and a small horizontal diffuse angle as compared with the light distribution pattern PB. The light distribution pattern PA includes a particularly bright hot zone HZA near the elbow point E. This hot zone HZA contributes to the hot zone HZL of the low-beam light distribution pattern PL.

The hot zone HZA is formed due to the reflecting element 14*s* that is disposed away from the optical axis Ax. More specifically, the diffuse angle of the light reflected by the reflecting elements 14*s* disposed away from the optical axis Ax is smaller than the diffuse angle of the light reflected by the reflecting element 14*s* disposed near the optical axis Ax, i.e., the light reflected by the reflecting elements 14*s* disposed away from the optical axis Ax forms a relatively small image of the light source. Moreover, because the reflecting elements 14*s* disposed away from the optical axis Ax are arranged around the direction orthogonal to the light emitting surface of the light emitting chip 12*a* of the light emitting element 12, the amount of light incident thereon is larger than that on the reflecting element 14*s* disposed near the optical axis Ax.

The light distribution pattern PB is formed by the light that is downwardly deflected in the direction approaching the optical axis Ax by the first lens portion 16A of the direct light control member 16, and is formed below the horizontal cut-off line CL1 on a right side of the line V-V.

The light distribution pattern PB is formed by controlling the light that is incident on the first lens portion 16A directly from the light emitting element 12, and a contour thereof is more vague (i.e., less sharp and well-defined) as compared with a contour of the light distribution pattern PA. Therefore, the light distribution pattern PB is suitable for forming a right inner diffuse area of the low-beam light distribution pattern PL.

As described above, the lamp unit 10 according to the first exemplary embodiment has the optical axis Ax extending in the front-and-rear direction, and the light emitting element 12 is disposed on the optical axis Ax such that the light emitting surface of the light emitting chip 12*a* faces the inner side in the width direction. The first reflector 14 is disposed on the inner side of the light emitting element 12 with respect to the width direction to forwardly reflect the light from the light emitting element 12. Therefore, the light emitting element 12 is arranged such that the direction orthogonal to the light emitting surface of the light emitting chip 12*a* is not largely deviated from the front edge portion of the reflecting surface 14*a*. Accordingly, a small and bright image of the light source can be formed by the light that is reflected by the reflecting surface 14*a* of the first reflector 14, whereby the light distribution pattern PA having the sufficiently bright hot zone HZA can be formed.

The lamp unit 10 according to the first exemplary embodiment further includes the direct light control member 16 just in front of the light emitting element 12, i.e., on a front side of the light emitting element 12 but on a rear side of the front edge 14*b* of the first reflector 14. The direct light control member 16 controls the light that is directed toward the region in front of the first reflector 14 from the light emitting element 12 without being incident on the first reflector 14. The direct light control member includes the first lens portion 16A operable to deflect the light in the direction approaching the optical axis Ax and the extended portion 16B extending toward the inner side from the first lens portion 16A in the width direction to control the light in a different way from the first lens portion 16A. Accordingly, the following advantages can be obtained.

The light distribution pattern PB can be formed in addition to the light distribution pattern PA by deflecting the light that is directly incident on the first lens portion 16 from the light emitting element 12 in the direction approaching the optical axis Ax. Thus, it possible to make effective use of the luminous flux of the light source, thereby improving the lamp efficiency.

In the related art, the light directed toward a region in front of the reflector from the light emitting element creates a disadvantageous effect in that this light generates a glare light rather than contributing to the light distribution pattern. However, in the first exemplary embodiment, the rear edge of the extended portion 16B is disposed substantially on the straight line L connecting the light emitting center of the light emitting element 12 and the front edge 14*b* of the reflecting surface 14*a* of the first reflector 14. Therefore, almost all the light directed toward the region in front of the first reflector 14 from the light emitting element 12 can be controlled by the direct light control member 16.

On an edge portion of the direct light control member 16 on the inner side in the width direction, it is difficult to precisely deflect the light from the light emitting element 12 in the direction approaching the optical axis Ax as compared with a portion of the direct light control member 16 that is closer to the optical axis Ax. However, because the edge portion of the direct light control member 16 on the inner side in the width direction is configured as the extended portion 16B that is operable to control the light differently from the first lens portion 16A, the light directly incident from the light emitting element 12 can be suitably controlled by the entire portion of the direct light control member 16.

Further, although the direct light control member 16 is provided just in front of the light emitting element 12 to provide a compact configuration, most of the light directed toward the region in front of the first reflector 14 from the light emitting element 12 can be captured to be incident on the direct light control member 16. Because the direct light control member 16 has such a compact configuration, the amount of light that is reflected by the first reflector 14 but is shielded by the direct light control member 16 can be made small. Further, the light reflected by the first reflector 14 but shielded by the direct light control member 16 is originally the light emitted in a rearward direction from the light emitting element 12 so that luminous intensity thereof is not high. Thus, the loss of luminous flux resulting from presence of the direct light control member 16 can be made sufficiently low.

Although the lamp unit 10 according to the first exemplary embodiment is configured as a reflector-type lamp unit having the light emitting element 12 as the light source, the lamp efficiency thereof can be improved while ensuring sufficient brightness for the hot zone HZA of the light distribution pattern PA formed by the light irradiated from the lamp unit 10.

In a case where the light deflection control is not precisely performed by the entire portion of the direct light control member 16, stray light may be generated. The stray light may be harmful when it is irradiated in the region in front of the first reflector 14. However, in the first exemplary embodiment, the engraving treatment is applied to the rear surface 16*a* of the extended portion 16B of the direct light control member 16. Therefore, the light that is incident on the rear surface 16*a* from the light emitting element 12 can be randomly diffused in the forward direction. According to this configuration, it is possible to prevent stray light from being generated and from being irradiated to the region in front of the first reflector 14. The light passed through the extended portion 16B becomes almost perfectly diffused light. Thus, glare light is prevented from being generated.

While the rear surface 16*a* of the extended portion 16B is subjected to the engraving treatment in the first exemplary embodiment, other kinds of surface treatment, e.g., a frost treatment or a light screening paint, may be applied to the rear surface 16*a* of the extended portion 16B to obtain similar advantages.

Further, while the light emitting surface of the light emitting chip 12*a* has a square shape in the first exemplary embodiment, the light emitting surface of the light emitting chip 12*a* may have other shapes, e.g., a rectangular shape whose dimensions are about 1 mm by about 2 mm. Furthermore, the light emitting element may be a light emitting diode or a laser diode in so far as it includes a surface emitting chip like the light emitting chip 12*a*.

Further, while the lamp unit 10 irradiates light to form a part of the low-beam light distribution pattern PL in the first exemplary embodiment, the lamp unit 10 may be used to irradiate light for forming a part of a high-beam light distribution pattern.

Further, while the light emitting element 12 is oriented to face the inner side in the width direction and the first reflector 14 is disposed on the inner side of the light emitting element 12 in the lamp unit 10 according to the first exemplary embodiment, similar functions and advantages can be obtained in so far as the light emitting element 12 is oriented to face in a direction that is substantially orthogonal to the optical axis Ax. For example, the light emitting element 12 may be oriented to face the outer side in the width direction and the first reflector 14 may be disposed on the outer side of the light emitting element 12. Similarly, the light emitting element 12 may be oriented to face upward and the first reflector 14 may be disposed above the light emitting element 12. Of course, the light emitting element 12 may be oriented to face downward and the first reflector 14 may be disposed below the light emitting element 12.

Further, while in the first exemplary embodiment, the lamp unit 10 is incorporated in a left side vehicle headlamp, the lamp unit 10 may also be incorporated into a right side vehicle headlamp. In a case where the lamp unit 10 is incorporated into the right side vehicle headlamp, the lamp unit 10 may have a configuration that is transversely reverse to the configuration of the first exemplary embodiment, or the lamp unit 10 may simply be shifted parallel so as to be incorporated into the right side vehicle headlamp.

Second Exemplary Embodiment

Next, a second exemplary embodiment of the present invention will be described.

Figure 4:
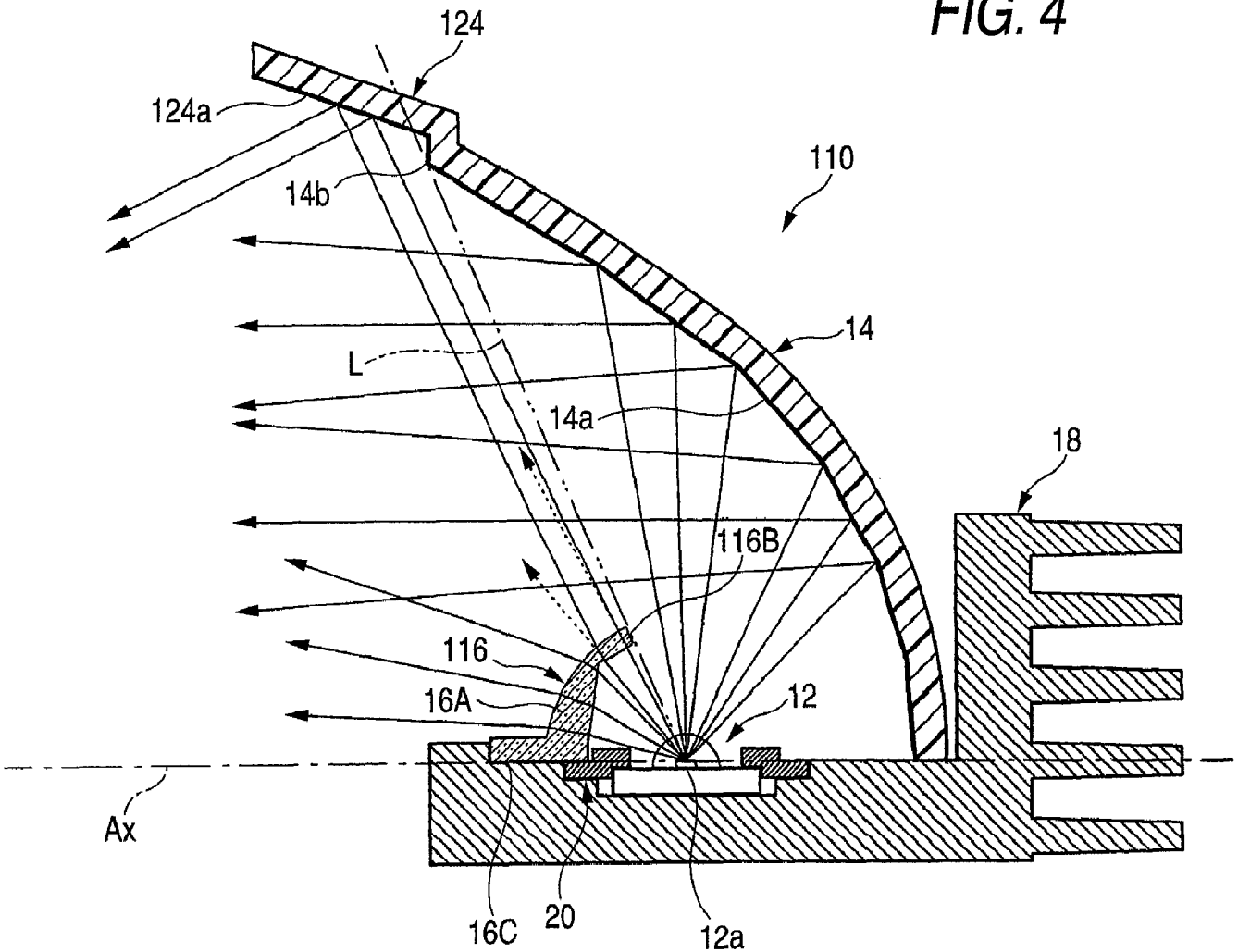
FIG. 4 is a sectional view showing a lamp unit according to a second exemplary embodiment of the present invention.

FIG. 4 is a sectional view showing a lamp unit 110 according to a second exemplary embodiment.

As shown in FIG. 4, a configuration of the lamp unit 110 is similar to that of the lamp unit 10 in the first exemplary embodiment. However, the lamp unit 110 is different from the lamp unit 10 in the first exemplary embodiment in that a configuration of an extended portion 116B of a direct light control member 116 is different, and in that a second reflector 124 is provided.

The extended portion 116B of the direct light control member 116, i.e., the portion of the direct light control member 116 on the inner side with respect to the width direction, is configured as a second lens portion which deflects light directly incident thereon from the light emitting element 12 in a direction away from the optical axis Ax.

A rear surface of the extended portion 116B is formed to have a convex curve in a cross section taken along a plane including the optical axis Ax. The extended portion 116B extends in a circumferential direction around the optical axis Ax. The extended portion 116B is operable to irradiate the light from the light emitting element 12 as substantially parallel light.

The second reflector 124 is disposed at a front of the first reflector 14, and reflects the light passing through the extended portion 116B from the light emitting element 12 in a direction toward the optical axis Ax.

The second reflector 124 has a reflecting surface 124*a* extending in the forward direction from a position at the inner side of the front edge 14*b* of the reflecting surface 14*a* of the first reflector 14 with respect to the width direction. The light incident on the reflecting surface 124*a* is downwardly reflected by the reflecting surface 124*a*.

The second reflector 124 extends in a circumferential direction along the front edge 14*b* of the first reflector 14. The first reflector 14 and the second reflector 124 are formed in a one-piece structure.

Figure 5:
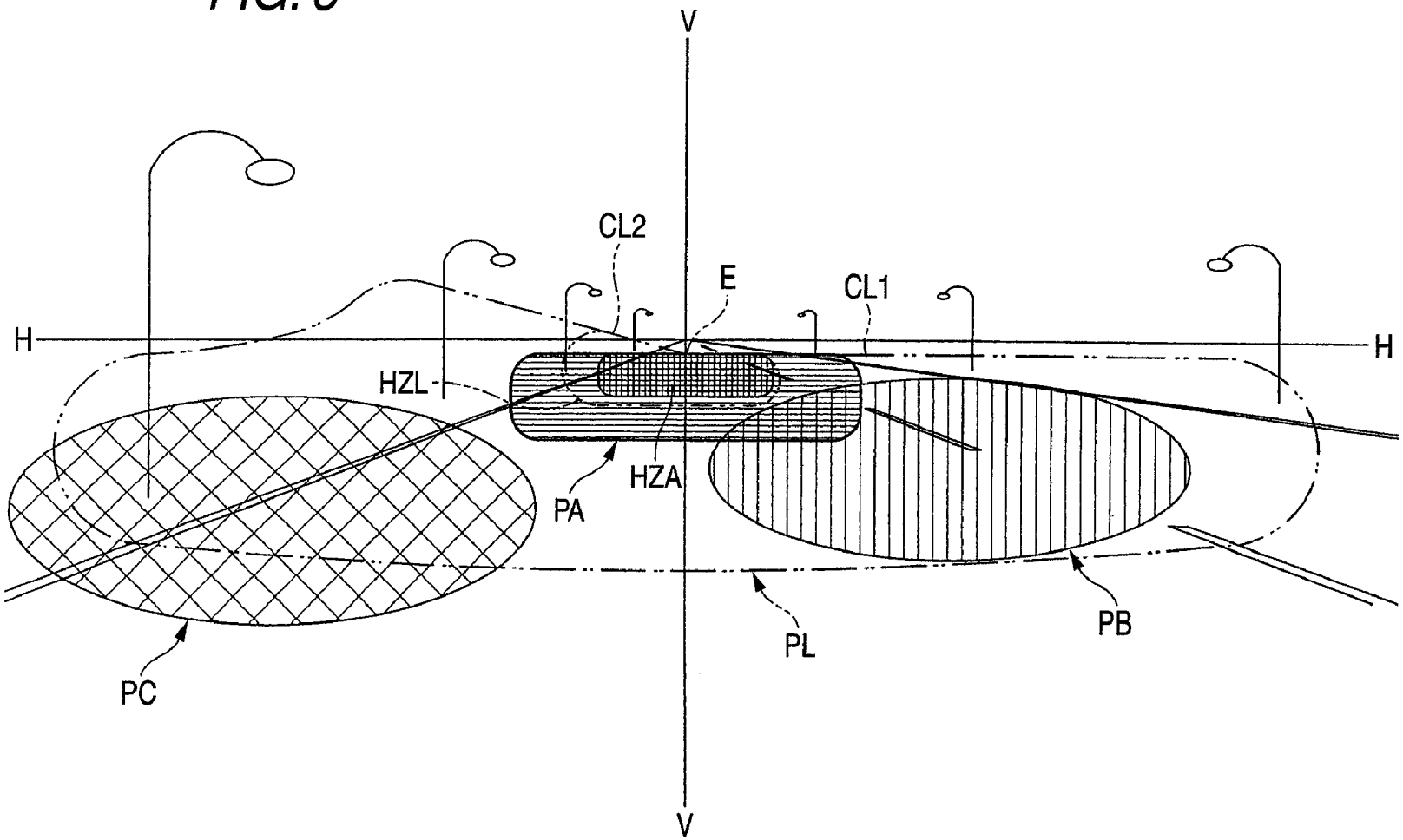
FIG. 5 is a perspective view showing three light distribution patterns projected, from the lamp unit of FIG. 4, on an imaginary vertical screen disposed at a position 25 m in front of the lamp unit.

FIG. 5 is a perspective view showing three light distribution patterns PA, PB, PC projected, from the lamp unit 100, on an imaginary vertical screen disposed at a position 25 m in front of the lamp unit 110.

As shown in FIG. 5, according to light irradiation from the lamp unit 110, the light distribution pattern PC is formed in addition to the light distribution patterns PA, PB.

The light distribution pattern PC is formed by the light that is emitted from the light emitting element 12, transmitted through the extended portion 116B and then reflected by the second reflector 124. The light reflected by the second reflector 124 is downwardly irradiated in a leftward direction. Therefore, the light distribution pattern PC is formed on the left side of the line V-V where the light distribution pattern PC partially overlaps a left lower end portion of the low-beam light distribution pattern PL.

According to the configuration of the second exemplary embodiment, the light distribution pattern PC can be additionally formed to irradiate a left part of a near zone in front of the lamp unit. Thus, for example, in the case where the lamp unit is used in a vehicle headlamp, a left shoulder of a road can be brightly illuminated to enhance visibility of pedestrians.

The light incident on the extended portion 116B from the light emitting element 12 includes the light that is incident on the portion of the direct light control member 116 on the inner side with respect to the width direction, the light having a relatively high luminous intensity. Therefore, the light distribution pattern PC can be made bright.

A shape of the reflecting surface 124*a* of the second reflector 124 may be modified to change an irradiating area, a shape, or a size of the light distribution pattern PC.

Third Exemplary Embodiment

Next, a third exemplary embodiment of the present invention will be described.

Figure 6:
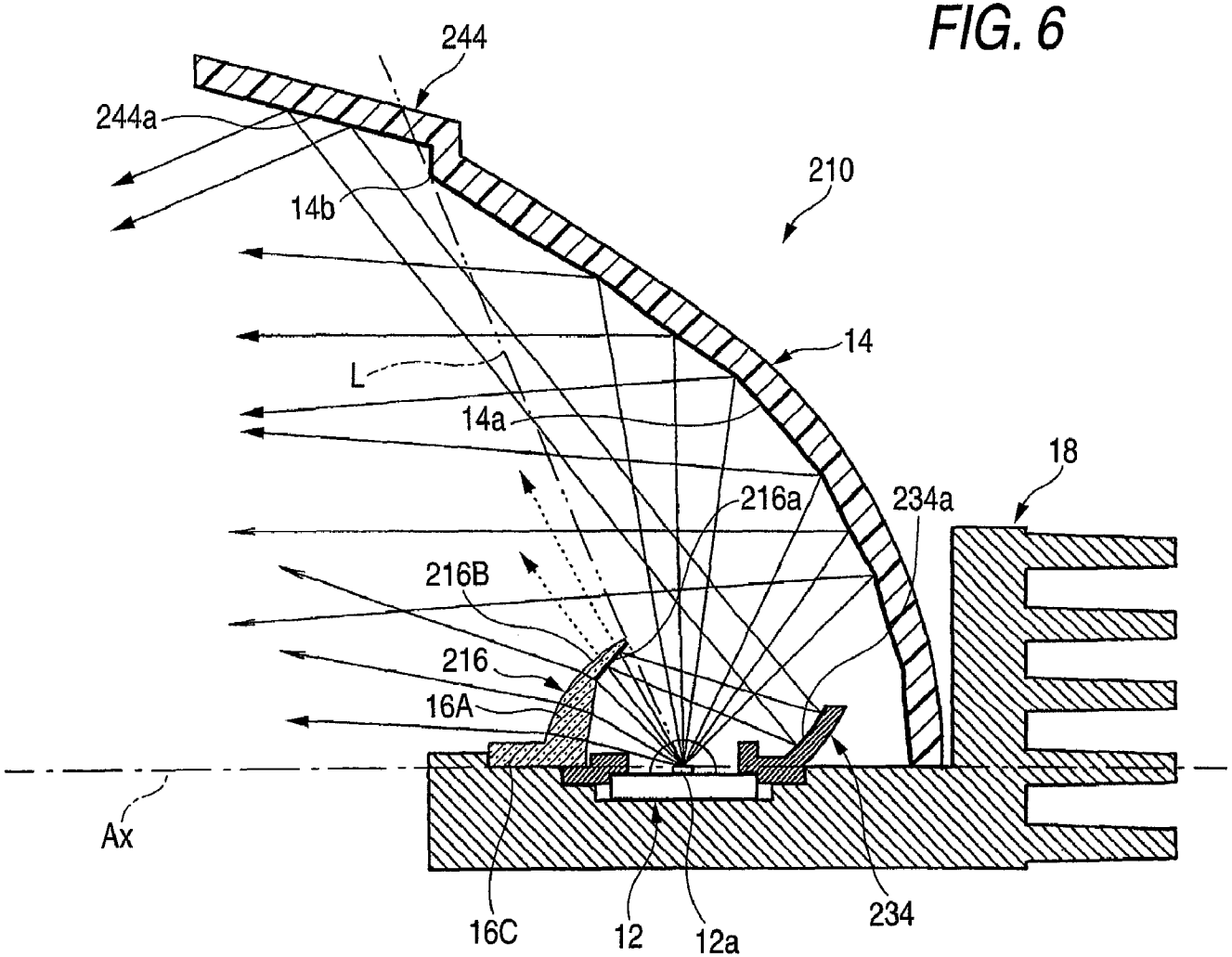
FIG. 6 is a sectional view showing a lamp unit according to a third exemplary embodiment of the present invention.

FIG. 6 is a sectional view showing a lamp unit 210 according to a third exemplary embodiment.

As shown in FIG. 6, a configuration of a lamp unit 210 is similar to that of the lamp unit 10 in the first exemplary embodiment. However, the lamp unit 210 according to the third exemplary embodiment is different from the lamp unit 10 of the first exemplary embodiment in that a configuration of an extended portion 216B of a direct light control member 216 is different, and in that third and fourth reflectors 234, 244 are provided.

A rear surface 216*a* of the extended portion 216B of the direct light control member 216 is subjected to a mirror finishing by means of, e.g., aluminum deposition or chrome deposition. The rear surface 216*a* of the extended portion 216B reflects the light directly incident thereon from the light emitting element 12 toward the rear side of the light emitting element 12 in a direction approaching the optical axis Ax.

The third reflector 234 is disposed on the rear side of the light emitting element 12. The third reflector 234 reflects the light reflected by the rear surface 216*a* of the extended portion 216B toward the region in front of the first reflector 14. The light reflected by the third reflector 234 is substantially parallel light in a plane including the optical axis Ax.

The third reflector 234 extends toward the inner side in the width direction from a rear end portion of the fixing member 20 in a shape of a cup. The third reflector 234 and the fixing member 20 are formed in a one-piece structure. A reflecting surface 234*a* of the third reflector 234 is formed by applying a mirror finishing to a surface of the third reflector facing the forward direction.

The fourth reflector 244 is disposed in front of the first reflector 14. The light reflected by the rear surface 216*a* of the extended portion 216B and the third reflector 234 in this order is reflected by the fourth reflector 244 in a direction toward the optical axis Ax.

The fourth reflector 244 has a reflecting surface 244*a* extending in the forward direction from a position at the inner side of the front edge 14*b* of the reflecting surface 14*a* of the first reflector 14 with respect to the width direction. The light incident on the reflecting surface 244*a* is downwardly reflected by the reflecting surface 244*a*.

The fourth reflector 244 extends in a circumferential direction along the front edge 14*b* of the first reflector 14. The first reflector 14 and the fourth reflector 244 are formed in a one-piece structure.

According to the configuration of the third exemplary embodiment, an additional light distribution pattern similar to the light distribution pattern PC in the second exemplary embodiment can be formed to irradiate a left part of a near zone in front of the lamp unit. Thus, for example in the case where the lamp unit is used in a vehicle headlamp, a left shoulder of a road can be brightly illuminated to enhance visibility of pedestrians.

The light incident on the extended portion 216B from the light emitting element 12 includes the light that is incident on the portion of the direct light control member 216 on the inner side with respect to the width direction of the vehicle, the light having a relatively high luminous intensity. Therefore, the additional light distribution pattern can be made bright.

A shape of the reflecting surface 244*a* of the fourth reflector 244 may be modified to change an irradiating area, a shape, or a size of the additional light distribution pattern.

In the exemplary embodiments described above, the extended portion may have any configuration in so far as the extended portion controls the second portion of the direct light differently from the first lens portion.

Further, while exemplary embodiments have been described with particular reference to an application in a vehicle lamp, the present inventive concept may also be applied to other vehicle lamps such as a headlamp, a fog lamp, or a cornering lamp, and to lamps other than vehicle headlamps, such as a spotlight or any other reflector type lamp which uses a light emitting element as a light source.

While description has been made in connection with exemplary embodiments of the present invention, those skilled in the art will understand that various changes and modification may be made therein without departing from the present invention. For example, numerical values in the above description of the exemplary embodiments may, of course, be set to different values as is advantageous. It is aimed, therefore, to cover in the appended claims all such changes and modifications falling within the true spirit and scope of the present invention.

What is claimed is:

1. A reflector-type lamp unit comprising:

a light emitting element which is disposed on an optical axis extending in a front-and-rear direction of the lamp unit, the light emitting element comprising a surface emitting chip oriented to face in a direction substantially orthogonal to the optical axis and a substrate supporting the surface emitting chip;

a first reflector which faces the light emitting element and forwardly reflects light from the light emitting element;

a direct light control member which is disposed in front of the light emitting element and controls direct light from the light emitting element, the direct light being light directed toward a region in front of the first reflector without being incident on the first reflector; and a bracket on which the substrate is fixedly supported, wherein the direct light control member comprises:

a base portion which is fixedly supported on the bracket at a position more forward than the substrate;

a first lens portion which extends from the base portion and deflects a first portion of the direct light in a direction approaching the optical axis; and an extended portion which extends from the first lens portion toward a rear side of the first lens portion, wherein the extended portion controls a second portion of the direct light differently from the first lens portion, wherein a rear surface of the extended portion is configured to randomly diffuse the second portion of the direct light.

2. The reflector-type lamp unit according to claim 1, further comprising a second reflector which is disposed at a front portion of the first reflector, wherein the extended portion comprises a second lens portion which deflects the second portion of the direct light in a direction away from the optical axis, and the second reflector reflects the second portion of the direct light, which is deflected by the second lens portion, in a direction toward the optical axis.

3. The reflector-type lamp unit according to claim 1, further comprising:

a second reflector which is disposed on a rear side of the light emitting element; and a third reflector which is disposed in front of the first reflector;

wherein a mirror finishing is applied to a rear surface of the extended portion to reflect the second portion of the direct light, the second reflector reflects the second portion of the direct light, which is reflected by the rear surface of the extended portion, toward the third reflector, and the third reflector reflects the second portion of the direct light, which is reflected by the second reflector, in a direction toward the optical axis.

4. The reflector-type lamp unit according to claim 1, wherein the optical axis and a direction in which a luminous intensity of the light emitting from the light emitting element is the highest are substantially at right angles to each other.

5. The reflector-type lamp unit according to claim 1, wherein a rear edge of the extended portion is positioned substantially on a straight line connecting a light emitting center of the light emitting element and a front edge of the first reflector.

6. The reflector-type lamp unit according to claim 1, wherein a front edge of the first reflector is disposed more forward than a front side of the direct light control member with respect to the front-and-rear direction of the lamp unit.

7. The reflector-type lamp unit according to claim 5, wherein the front edge of the first reflector is disposed more forward than a front side of the direct light control member with respect to the front-and-rear direction of the lamp unit.

8. The reflector-type lamp unit according to claim 1, wherein the first reflector is fixedly supported on the bracket.

9. The reflector-type lamp unit according to claim 8, wherein the bracket comprises a protruded portion operable to position the direct light control member with respect to the bracket.

10. The reflector-type lamp unit according to claim 1, wherein the bracket is metallic and is formed with radiator fins.

11. A lamp unit comprising:

a light emitting element which is disposed on an optical axis extending in a front-and-rear direction of the lamp unit, the light emitting element being oriented to face in a direction substantially orthogonal to the optical axis;

a first reflector which faces the light emitting element and forwardly reflects light from the light emitting element; and a direct light control member which is disposed in front of the light emitting element and controls direct light from the light emitting element, the direct light being light directed toward a region in front of the first reflector without being incident on the first reflector, wherein the direct light control member comprises:

a first lens portion which deflects a first portion of the direct light in a direction approaching the optical axis; and an extended portion which extends from the first lens portion toward a rear side of the first lens portion, wherein the extended portion controls a second portion of the direct light differently from the first lens portion;

further comprising a second reflector which is disposed at a front portion of the first reflector, wherein the extended portion comprises a second lens portion which deflects the second portion of the direct light in a direction away from the optical axis, and the second reflector reflects the second portion of the direct light, which is deflected by the second tens portion, in a direction toward the optical axis.

12. A lamp unit comprising:

a light emitting element which is disposed on an optical axis extending in a front-and-rear direction of the lamp unit, the light emitting element being oriented to face in a direction substantially orthogonal to the optical axis;

a first reflector which faces the light emitting element and forwardly reflects light from the light emitting element; and a direct light control member which is disposed in front of the light emitting element and controls direct light from the light emitting element, the direct light being light directed toward a region in front of the first reflector without being incident on the first reflector, wherein the direct light control member comprises:

a first lens portion which deflects a first portion of the direct light in a direction approaching the optical axis; and an extended portion which extends from the first lens portion toward a rear side of the first lens portion, wherein the extended portion controls a second portion of the direct light differently from the first lens portion;

further comprising a second reflector which is disposed on a rear side of the light emitting element; and a third reflector which is disposed in front of the first reflector;

wherein a mirror finishing is applied to a rear surface of the extended portion to reflect the second portion of the direct light, the second reflector reflects the second portion of the direct light, which is reflected by the rear surface of the extended portion, toward the third reflector, and the third reflector reflects the second portion of the direct light, which is reflected by the second reflector, in a direction toward the optical axis.

* * * * *